United States Patent [19]

Laufer et al.

[11] Patent Number: 4,733,640

[45] Date of Patent: Mar. 29, 1988

[54] FUEL INJECTION PUMP

[75] Inventors: Helmut Laufer, Gerlingen; Max Straubel, Stuttgart, both of Fed. Rep. of Germany

[73] Assignee: Robert Bosch GmbH, Stuttgart, Fed. Rep. of Germany

[21] Appl. No.: 857,665

[22] Filed: Apr. 30, 1986

[30] Foreign Application Priority Data

May 8, 1985 [DE] Fed. Rep. of Germany ..... 3516456

[51] Int. Cl.[4] ..... F02M 39/00

[52] U.S. Cl. ..... 123/198 D; 123/462; 123/479

[58] Field of Search ..... 123/198 D, 198 DB, 502, 123/479, 462, 458, 449, 359, 357, 358, 510, 511, 512, 513

[56] References Cited

U.S. PATENT DOCUMENTS 4,319,550 3/1982 Ishii ..... 123/198 DB
4,391,241 7/1983 Doshita ..... 123/198 DB
4,502,439 3/1985 Nagase ..... 123/357
4,565,170 1/1986 Grieshaber ..... 123/198 DB

*Primary Examiner*—Carl Stuart Miller
*Attorney, Agent, or Firm*—Edwin E. Greigg

[57] ABSTRACT

A fuel injection pump for internal combustion engines is described, which for controlling fuel quantity is provided with control unit that controls an electric final control element, which in turn actuates the regulating member that determines the fuel injection quantity per pump piston supply stroke. The supply of fuel to the pump work chamber is effected from a fuel supply chamber, which is kept at a controlled pressure by a fuel feed pump. To limit the maximum speed of the engine supplied by the fuel injection pump in the event of failure of the control unit, a valve is provided in the intake line of the fuel feed pump. Using this valve, the flow cross section of the intake line can be varied or closed. By means of the modification of the fuel pressure in the fuel supply chamber effected thereby, a control of the fuel injection quantity that is not dependent on the position of the quantity-determining member is attained.

13 Claims, 3 Drawing Figures

FUEL INJECTION PUMP

BACKGROUND OF THE INVENTION

The invention is directed to improvements in fuel injection pumps whose supply pressure is controllable by a valve in accordance with at least one operating characteristic of the engine.

In a fuel injection pump of this type, disclosed in F.R.G. Pat. No. 19 13 808, the valve, in the form of an electrically controllable valve, is disposed in the fuel supply line leading from the fuel supply chamber of the pump to the pump work chamber. The valve is a magnetic valve, the closing member of which is located in the closing position when the coil is not excited. When the fuel injection pump is in operation, the magnetic valve is moved into its opening position by an rpm signal and is kept there until such time as the rpm exceeds a predetermined value. When this value is exceeded the result is an interruption of the supply of electric current to the magnetic valve, so that the fuel supply line is closed by the closing member of the magnetic valve. The rpm threshold value is detected via fuses located in the current supply circuit of the magnetic valve, which via a response value limit the rpm-dependent current load on the magnetic valve. The control provided in the known apparatus serves to shut off the engine if the maximum rpm is exceeded.

OBJECT AND SUMMARY OF THE INVENTION

It is an object of the invention to provide a fuel injection pump having the advantage over the prior art that the engine can continue to be operated even if an unusual operating condition should arise. Because of the pressure drop in the fuel supply chamber that is produced by the controllable valve in the intake line or bypass line, the extent to which the pump work chamber is filled by the individual intake strokes of the pump piston is advantageously decreased, and thus the supply of fuel to the engine associated with the fuel injection pump is decreased as well. This action takes place independently of a control device otherwise provided for controlling the fuel injection quantity. In this way, the maximum vehicle speed or maximum rpm of the engine driving the vehicle can be limited on the one hand, and on the other hand emergency operation of the engine is possible in the event that the associated control device for the fuel injection quantity should fail.

It is another object of the invention to provide fail-safe operation whenever an electronic control unit is provided as the control device. The person operating the machine is then capable of arbitrarily actuating the valve. The engine can be driven at low load if the intake line or bypass line is opened or closed in a throttled manner. If the intake line is fully open, then an injection quantity adjustment takes place, corresponding to a defined position of the quantity control element controlled by the control device.

A further effect of throttling the intake line or the bypass line is that because of the attendant decreasing pressure in the fuel supply chamber, the control of injection time that is provided for the fuel injection pump is varied as well; for instance, with rpm-dependent pressure control in the fuel supply chamber, the injection onset is shifted toward "late". This in turn has the further effect of reducing the efficiency of the fuel injection pump, so that the rpm or power of the engine is reduced and the engine is in danger of overheating. This problem is alleviated by providing a means by which the injection time control can be brought to a conventional mean value position despite the reduction in fuel pressure in the fuel supply chamber.

It is yet another object of the invention that controlling a reduced pressure by adjusting the valve is advantageously facilitated by relieving the fuel supply chamber via a pressure maintenance valve, rather than via an open throttle connection.

The invention will be better understood and further objects and advantages thereof will become more apparent from the ensuing detailed description of a preferred embodiment taken in conjunction with the drawings.

DESCRIPTION OF THE PREFERRED EMBODIMENTS

Figure 1:
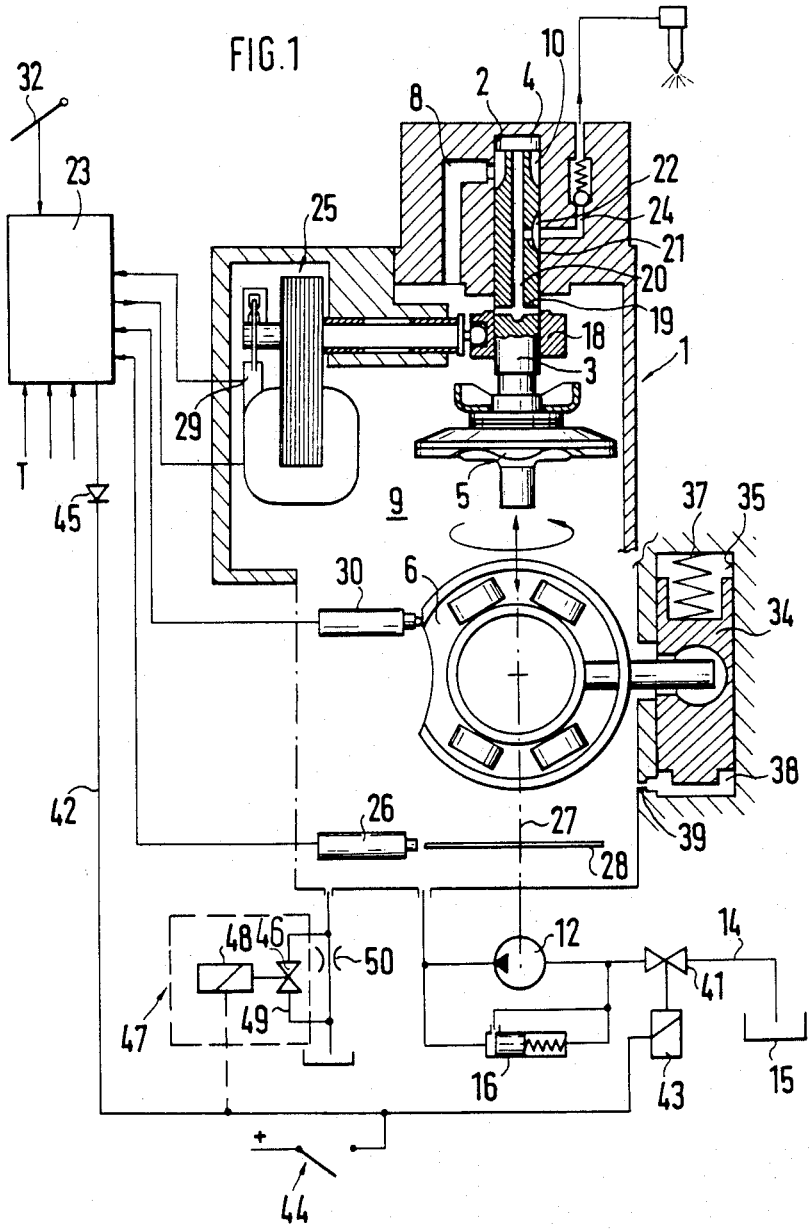
FIG. 1 shows a first exemplary embodiment of the invention in a partially schematic arrangement having a valve located in the intake line or in the bypass line around the overflow throttle and being switchable upon exceeding a set maximum rpm or for shutting off the engine.

In the exemplary embodiment shown in FIG. 1, a cylinder bore 2 is provided in a pump housing 1 of a fuel injection pump. A pump piston 3 defines a pump work chamber 4 in the cylinder bore 2. The pump piston is driven in rotation by means not shown via a cam disk 5, which runs on a roller ring 6 (in this drawing, this is shown offset by 90° into the plane of the drawing), and as it rotates it executes a reciprocating pumping movement with an intake stroke and a supply stroke. The supply of fuel to the pump work chamber is effected via a fuel supply conduit 8, which leads from a fuel supply chamber 9 into the cylinder 2, its entry being controlled via longitudinal grooves 10 originating at the end face of the pump piston. The fuel supply chamber is located inside the pump housing and is supplied with fuel by means of a fuel feed pump 12, which is driven synchronously with the pump piston. To this end, the fuel feed pump communicates via an intake line 14 with a fuel supply tank 15. Parallel to the fuel feed pump, there is a pressure control valve 16, by means of which, beyond the rpm-dependent pumping of the fuel feed pump, the pressure in the fuel supply chamber 9 is controlled. In order to perform control of the instant of injection, this pressure is preferably dependent on the rpm at which the fuel injection pump is driven.

The pump piston protrudes into the fuel supply chamber on the side toward the cam disk and this part of the pump piston has an annular slide 18, with the upper edge of which the outlet of a transverse bore 19 on the pump piston into the fuel supply chamber 9 can for instance be controlled. A longitudinal bore 20 begins at the transverse bore 19 and communicates continuously, as a relief conduit, with the pump work chamber 4. Branching off from this relief conduit is a radial bore 21 that discharges into a distributor groove 22. As the pump piston rotates, this groove 22 is brought into successive communication with one fuel injection line 24 at a time. The fuel injection lines are disposed on the circumference of the cylinder bore 2 in the operative region of the distributor groove 22 in accordance with the number of engine cylinders to be supplied.

The annular slide 18 serves to control fuel quantity and is axially displaced on the pump piston by an electromagnetic final control element 25; the quantity of fuel pumped into one of the injection lines per pumping stroke of the pump piston is the greater, the more the annular slide 18 is displaced toward top dead center of the pump piston. The electromagnetic final control element 25 is controlled by a control device that emits a control signal to the electromagnetic final control element in accordance with operating parameters. As operating parameters, the rpm of the engine is detected via an rpm transducer 26, which cooperates with a gear disk 28 coupled to the drive shaft 27 of the fuel injection pump. The position assumed by the electromagnetic final control element 25 is also detected by a feedback transducer 29, and the location of the instant of injection for overall injection control is ascertained with an injection time transducer 30. In this exemplary embodiment, this may be a transducer that detects the position of the roller ring, but other injection time transducers, such as needle stroke transducers and the like, may also be provided. Via a gas pedal 32, the torque desired by the driver operating the engine is fed to the control device 23. Other parameters, such as the temperature T or the density of the air supplied to the engine combustion chambers, can be taken into account in forming the fuel quantity signal. Controls of this kind are well known and need no further description here.

To adjust the injection timing, an injection adjuster piston 34 is also provided, which is displaceable in a working cylinder 35 and is coupled with the roller ring 6. One side of the injection adjusting piston 34 is loaded by a restoring spring 37 and the other side encloses a work chamber 38 in the working cylinder; the work chamber 38 communicates with the fuel supply chamber 9 via a throttle 39. As the pressure in the fuel supply chamber rises with the increasing rpm, the injection adjuster piston 34 is displaced counter to the force of the spring 37 and thereby rotates the roller ring 6 such that the piston stroke movement takes place at an earlier rotational angle of the injection pump drive shaft 27.

The above-described system relates to a known fuel injection pump of the distributor pump type, having electrical control. Electrical controls of this kind may fail for various reasons, or may malfunction, and so supplementary measures are advantageously provided to assure that a maximum rpm of the engine supplied by the fuel injection pump cannot be exceeded, to enable reliable shutoff of the engine, and to maintain emergency operation of the engine if the electric control unit should fail. In this emergency operation, it must be assured that the engine can be operated at least at low load until such time as the vehicle can escape from a dangerous situation or can be driven under its own power to a repair facility. To this end, a valve 41 is provided in the intake line 14, located downstream of where the relief line leading from the pressure control valve discharges into the intake line. In the example shown in FIG. 1, the valve 41 is an electromagnetically actuated switching valve that is triggered by the control unit 23. This control unit has supplementary electronics, which if a maximum permissible rpm is exceeded emits a control signal via a control line 42 to the magnetic coil 43 of the magnetic valve 41. If the permissible rpm is exceeded, the magnetic valve 41 is closed, so that the fuel feed pump 12 cannot pump any more fuel into the fuel supply chamber. The internal pressure in the chamber then drops, and in the individual intake strokes of the pump piston 3, the pump work chamber is no longer filled completely, or is filled at reduced pressure. The injection pumping capacity of the pump piston drops accordingly, and the fuel injection quantity is reduced. As a result, the rpm, which had previously been exceeded, drops once again, and the valve 41 can be opened. In this manner, engine operation can be maintained despite a defectively operating control unit, yet without exceeding the maximum rpm.

In supplementation to this arrangement, a switch 44 is provided, in the closing position of which the control line 42 is supplied with a fixed voltage, which likewise closes the valve 41. The control unit 23 may be protected by an uncoupling diode 45 incorporated into the control line 42. The engine can be brought to a stop in a simple manner with this switch 44. The switch may be wired so as to reinforce some other shut-off provision, so that the rapid drop, effected by the switch 44, of the fuel pressure in the fuel supply chamber 9 makes the shutoff take place faster.

An alternative 47 to the above-described option for varying the fuel pressure in the fuel supply chamber 9 functions similarly. The device 47 comprises an electromagnetic valve 46, which is located in a bypass line 49 around an overflow throttle 50 and actuated by a magnetic coil 48; in a known manner, part of the fuel pumped into the fuel supply chamber 9 is diverted again by this valve 46, so as to scavenge the fuel supply chamber and keep it free of vapor bubbles. In order for this alternative to function properly, however, the then-operative cross section of the valve 46 must be relatively large, however, since the fuel pump 12 continues to introduce the entire supply quantity into the fuel supply chamber.

If the fuel injection pump is operated with the injection timing control device provided in FIG. 1, then the drop in the fuel pressure in the fuel supply chamber shifts the injection timing toward "late". However, this also lowers the efficiency of the engine, and the toxic component of the engine exhaust gases increases because of the incomplete combustion that then takes place. In particular for limiting the maximum rpm, it is accordingly advantageous to provide a supplementary measure, in which when the valve 41 in the intake line 14 is switched a minimum pressure is maintained in the work chamber 38 before the injection adjuster piston 34.

Figure 2:
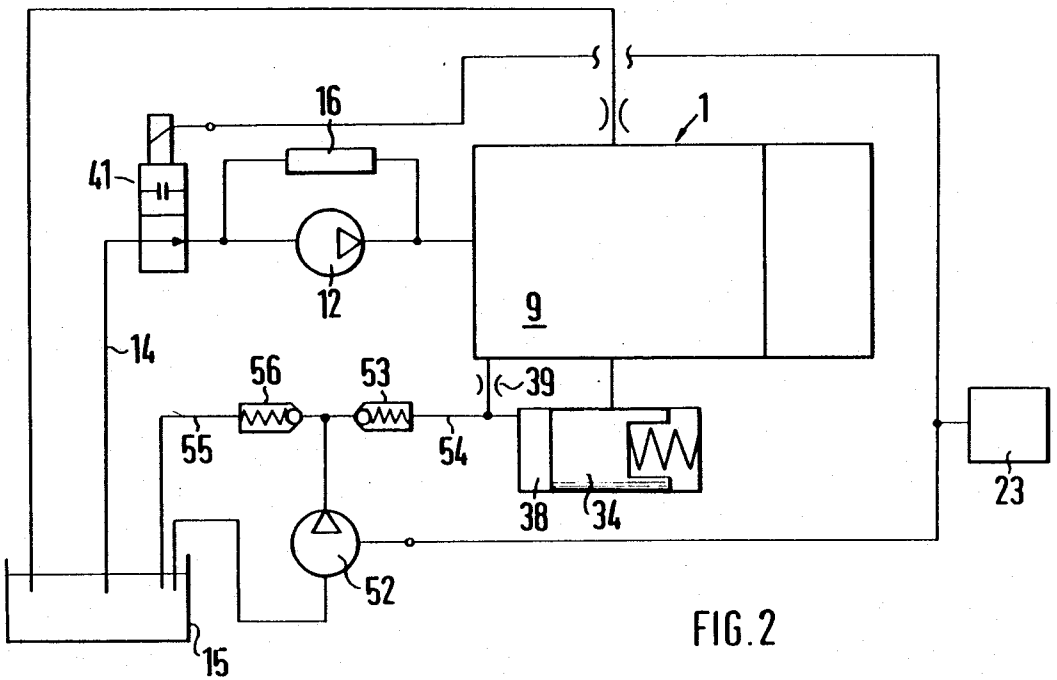
FIG. 2 is another version of the exemplary embodiment of FIG. 1, showing an additional feed pump for supplying an injection adjuster with pressure medium.

FIG. 2 schematically shows the fuel injection pump 1 with the injection timing adjuster, the work chamber 38 of which communicates via the throttle 39 with the fuel supply chamber 9. Aside from the fuel feed pump 12, an additional fuel feed pump 52 is also provided, which aspirates fuel from the fuel supply tank 15 and delivers it to the work chamber 38 via a pressure line 54 that contains a check valve 53. Between the fuel feed pump 52 and the check valve 53 a relief line 55 branches off, returning to the fuel supply tank 15; it contains a pressure limiting valve 58, by means of which the fuel pressure in the work chamber 38 can be limited to a value of 7 bar, for instance. The additional fuel feed pump 52 is triggered by the control unit 23 simultaneously with the valve 41 and put into operation as soon as the valve 41 has been put into its closing position. This assures that an at least approximate instant of injection is established, while the fuel pressure in the fuel supply chamber 9 can be dropped to a more or less great extent. This also enables better performance when the engine is put back into normal operation.

Figure 3:
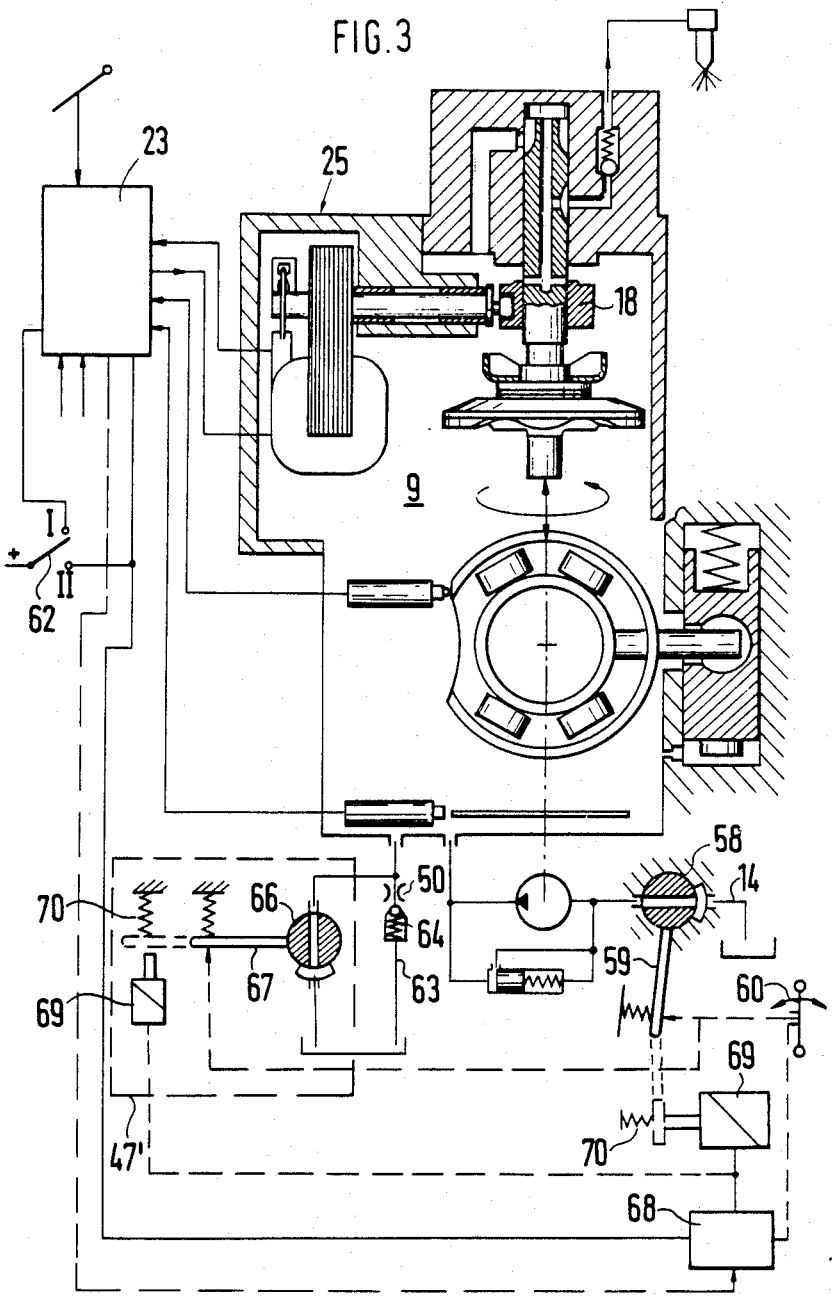
FIG. 3 shows a third exemplary embodiment, based on FIG. 1, having a controllable cross section in the intake line or in the bypass line around the overflow throttle.

This arrangement is advantageously usable in the exemplary embodiment of FIG. 3 as well. This system contains substantially the same structural components as that of FIG. 1, except that the valve 41, which in the foregoing embodiments was in the form of a switching valve, is now embodied as a valve with a variable flow cross section. Thus an adjustable throttle 58 is provided in the intake line 14 instead of the valve 41, and this throttle 58 is provided with an actuating element 59. The actuating element is adjustable by means of an adjusting lever 60, which is actuable by the driver of the vehicle. A switch 62 is also provided, which can be switched automatically or by the vehicle driver out of a first switching position I shown in FIG. 3 into a second switching position II if the electric control unit is not functioning properly. In position I, the switch 62 supplies the control unit 23 with the operating voltage, which in position II is fed to the control unit 23 in such a way that the unit 23 moves the electromagnetic final control element 24 into a preferred position in the partial-load range.

The system of FIG. 3 described thus far operates such that in the event that the electric control unit is no longer functioning properly, the annular slide 18 that determines the injection quantity is moved into a preferred position by the final control element 25. The fuel quantity injected in this position can be still further modified by throttling the intake line 14 to a greater or lesser extent. With the lever 60, the driver of the vehicle can adjust the throttle 58 and thereby reduce the fuel pressure in the fuel supply chamber 9, for example. As a result, the fuel injection quantity that is pumped is reduced as compared with the quantity that is determined by the position of the annular slide 18. Depending upon the extent of throttling, output can be regulated for emergency operation, even within narrow limits. To this end, a check valve 64 is advantageously provided in the relief line 63 containing the overflow throttle 50; the check valve 64 establishes a minimum pressure in the fuel supply chamber 9.

This embodiment, like that of FIG. 1, can again be modified by providing an alternative 47', in which an adjustable throttle 66 is disposed parallel to the overflow throttle 50. This throttle 66 would then be adjusted by the adjusting lever 60 via an actuating lever 67, in a manner analogous to the throttle 58. Instead of a mechanical coupling between the adjusting lever 60 and the actuating lever 59 or 67, an electric coupling may be provided, in which the adjusting movement of the adjusting lever 60 is transmitted to a control circuit 68 that is activated in position II of the switch 62 and controls a control motor 69 in accordance with the angular position of the adjusting lever 60. The motor 69 adjusts the actuating member 59, counter to the force of a restoring spring 70. Once again it is particularly advantageous if the work chamber 38 can be acted upon by an additional source of control pressure, which over the duration of emergency operation assures an approximately correct instant of injection. In addition to this arrangement, the control circuit 68 or the control motor 69 may also be triggered by an excessive-rpm protecting means similarly to the exemplary embodiment of FIG. 1.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising a fuel supply chamber arranged to supply fuel provided by a fuel feed pump to a pump work chamber, said pump work chamber being defined by a pump piston disposed within a cylinder bore of the fuel injection pump, said feed pump communicating via an intake line with a fuel supply tank from which said fuel is drawn, the pressure in said fuel supply chamber being controllable in accordance with at least one operating parameter of the internal combustion engine via at least one valve means, said at least one valve means being controlled by signal means indicating occurrence of a special operating state of the engine to vary fuel supply to the pump work chamber from the fuel supply chamber, said signal means including an electric control unit arranged to control a fuel injection quantity regulating member associated with said pump piston for determining a fuel injection quantity deliverable by each supply stroke of said pump piston, said at least one valve means being disposed in said intake line and being controllable to assume selectively variable valve opening positions for a duration of said special operating state, said at least one valve means being actuatable in a closing direction to restrict fuel flow and thus to effect a pressure drop in the fuel supply chamber, whereby control of said fuel injection quantity is provided in an engine emergency when a failure of normal injection control occurs.

2. A fuel injection pump for internal combustion engines comprising a fuel supply chamber arranged to supply fuel provided by a fuel feed pump to a pump work chamber, said pump work chamber being defined by a pump piston disposed within a cylinder bore of the fuel injection pump, said feed pump communicating via an intake line with a fuel supply tank from which said fuel is drawn, the pressure in said fuel supply chamber being controllable in accordance with at least one operating parameter of the internal combustion engine via at least one valve means, said at least one valve means being controlled by signal means indicating occurrence of a special operating state of the engine to vary fuel supply to the pump work chamber from the fuel supply chamber, said signal means including an electric control unit arranged to control a fuel injection quantity regulating member associated with said pump piston for determining a fuel injection quantity deliverable by each supply stroke of said pump piston, said at least one valve means being disposed in a bypass line arranged to circumvent an overflow throttle adapted to relieve said fuel supply chamber, said at least one valve means being controllable to assume selectively variable valve positions for a duration of said special operating state, one of said variable valve positions being an opening position in which a fuel pressure drop is effected in the fuel supply chamber, whereby control over said fuel injection quantity is provided in an engine emergency during normal injection control failure.

3. A fuel injection pump as defined by claim 1, in which said at least one valve means is provided with an effective flow cross section which is arbitrarily variable.

4. A fuel injection pump as defined by claim 2, in which said at least one valve means is provided with an effective flow cross section which is arbitrarily variable.

5. A fuel injection pump as defined by claim 1, in which said at least one valve means is electrically controllable into a closed position when an adjustable rpm value of the engine is exceeded.

6. A fuel injection pump as defined by claim 2, in which said at least one valve means is electrically controllable into an open position when an adjustable rpm value of the engine is exceeded.

7. A fuel injection pump as defined by claim 5, in which an injection timing adjuster comprising an injection adjuster piston disposed in a cylinder bore, said adjuster piston having a first side acted upon by a restoring force and a second side defining a further work chamber with said cylinder, said further work chamber communicating with the fuel supply chamber, a second fuel feed pump adapted to supply said further work chamber via a second intake line having a check valve disposed therein, said fuel feed pump supplying fuel at a pressure controlled by a pressure control valve simultaneously with actuation of said at least one valve means and said second intake line having a throttle disposed therein between the further work chamber of the injection adjuster and the fuel supply chamber.

8. A fuel injection pump as defined by claim 6, in which an injection timing adjuster comprising an injection adjuster piston disposed in a cylinder bore, said adjuster piston having a first side acted upon by a restoring force and a second side defining a work chamber with said cylinder, said further work chamber communicating with the fuel supply chamber, a second fuel feed pump adapted to supply said further work chamber, a second intake line having via a check valve disposed therein, said fuel feed pump supplying fuel at a pressure controlled by a pressure control valve simultaneously with actuation of said at least one valve means and said second intake line having a throttle disposed therein between the further work chamber of the injection adjuster and the fuel supply chamber.

9. A fuel injection pump as defined by claim 6, in which the fuel supply chamber is relieved via a pressure maintenance valve.

10. A fuel injection pump as defined by claim 8, in which the fuel supply chamber is relieved via a pressure maintenance valve.

11. A fuel injection pump as defined by claim 6, in which a switch is adapted to be connected to the electric control unit so that upon failure of said electric control unit, a portion of the electric control unit can be connected to a voltage supply whereby the fuel injection quantity regulating member of the fuel injection pump can be brought into a predetermined, constant position.

12. A fuel injection pump as defined by claim 8, in which a switch is adapted to be connected to the electric control unit so that upon failure of said electric control unit, a portion of the electric control unit can be connected to a voltage supply whereby the fuel injection quantity regulating member of the fuel injection pump can be brought into a predetermined, constant position.

13. A fuel injection pump as defined by claim 10, in which a switch is adapted to be connected to the electric control unit so that upon failure of said electric control unit, a portion of the electric control unit can be connected to a voltage supply whereby the fuel injection quantity regulating member of the fuel injection pump can be brought into a predetermined, constant position.

* * * * *